US005824272A

United States Patent [19]

Uchida

[11] Patent Number: 5,824,272

[45] Date of Patent: Oct. 20, 1998

[54] COMPOUND CENTRIFUGE TUBE

[76] Inventor: Toshiki Uchida, 20-17-303, Hoshikuma 2-chome, Jonan-ku, Fukuoka-shi, Fukuoka, Japan

[21] Appl. No.: 768,074

[22] Filed: Dec. 16, 1996

[51] Int. Cl.[6] ..... B01L 3/00

[52] U.S. Cl. ..... 422/102; 422/100; 422/101; 422/103; 422/72; 436/177; 436/180; 210/323.2; 210/360.1

[58] Field of Search ..... 422/70, 72, 101, 422/102, 103, 104, 100; 436/177, 178, 180; 210/323.2, 360.1, 513, 520, 657

[56] References Cited

U.S. PATENT DOCUMENTS

| | | | |
|---|---|---|---|
| 4,956,298 | 9/1990 | Diekmann | 430/311 |
| 5,356,814 | 10/1994 | Carrico, Jr. et al. | 435/286 |
| 5,491,067 | 2/1996 | Setcavage et al. | 435/7.25 |
| 5,501,841 | 3/1996 | Lee et al. | 422/101 |
| 5,552,325 | 9/1996 | Nochumson et al. | 436/177 |
| 5,575,914 | 11/1996 | Jeyendran | 210/445 |
| 5,601,711 | 2/1997 | Sklar et al. | 210/238 |

FOREIGN PATENT DOCUMENTS

A-8-108096 4/1996 Japan .

*Primary Examiner*—Harold Y. Pyon

*Attorney, Agent, or Firm*—Griffin, Butler Whisenhunt & Szipl,LLP

[57] ABSTRACT

There is provided a compound centrifuge tube including a larger volume bottomless portion, and a smaller volume portion having a bottom and formed just below the larger volume portion. The smaller volume portion is designed to be separable from the larger volume portion, for instance, by forming an annular groove at an outer surface of the tube so that a boundary between the larger and smaller portions has a smaller wall-thickness than other portions. For another instance, there may be formed threaded portions both at a lower end of the larger volume portion and at an upper end of the smaller volume portion so as to detachably engage those two portions to each other. In accordance with the compound centrifuge tube, a cell pellet remain unremoved at a distal end of the smaller volume portion even after centrifugation and washing. Thus, it is no longer necessary to transfer the cell pellet into a micro-tube with a pipette unlike a conventional centrifugal separation tube where it is necessary to transfer a cell pellet to a micro-tube from the tube after centrifugation/washing.

15 Claims, 7 Drawing Sheets

COMPOUND CENTRIFUGE TUBE

BACKGROUND OF THE INVENTION

1. Field of the Invention

The invention relates to a compound centrifuge tube capable of efficiently accomplishing centrifugation/washing, freeze-preserving cells and extracting genes. The compound centrifuge tube is to be used for separation of various cell ingredients such as lymphocytes, stem cells and cancer cells from blood and structures in the field of analysis in cellular immunology and molecular biology.

2. Description of the Prior Art

When various cell ingredients are to be separated from one another in a conventional centrifugal separation method, a resultant solution is transferred to a 0.5 to 1.5 ml volume micro-tube from a 10 to 15 ml volume or 50 ml volume container to be used for centrifugation. In quite a few cases, cells are preserved or disposed in the container without transferring to the micro-tube.

In a conventional method, centrifugation/washing is repeated 2 or 3 times in a centrifugal separation tube having a large volume. Then, supernatant liquid is discarded. Then, a small amount of solvent is added to a cell pellet, namely, precipitate left in the centrifugal separation tube to thereby loosen cells. Herein, the solvent is used in an amount of 1.25 to 1.5 ml which is much smaller than an amount used for washing. Thus-obtained cellular suspension is then transferred to a micro-tube with a pipette. The cellular suspension in the micro-tube is centrifuged to thereby produce a new cell pellet in the micro-tube. The thus newly produced cell pellet is either preserved as it is or freeze-preserved with freeze-preserving solution. As an alternative, DNA or RNA is extracted directly from the cell pellet.

As mentioned above, in a conventional method where a resultant solution has to be transferred from a centrifugal separation tube to a micro-tube, cellular suspension has to be produced only for transferring the resultant solution, which adds one more step of loosening the cell pellet to the method.

In addition, the conventional method includes an additional step of accomplishing centrifugation for producing a cell pellet after transferring the cellular suspension to a micro-tube. This step may pose a problem that much damage is done to the cells.

Furthermore, in a step of transferring the cellular suspension to the micro-tube, there may arise a problem that many cells stick to both an inner wall of the centrifugal separation tube prior to transferring the cellular suspension and an inner wall of a pipette used for transferring the cellular suspension, because the highly concentrated cellular suspension is loosened in a small amount of solvent, specifically 1.25 to 1.5 ml of solvent.

The conventional centrifugal separation tube has further problems as follows. The step of transferring the cellular suspension requires much labor. In addition, there would need a space for preserving the cellular suspension in a centrifugation container. When supernatant liquid is to be discarded after centrifugation separation, a part of precipitate, namely, cell pellet may be thrown away together with the supernatant liquid.

SUMMARY OF THE INVENTION

In view of the foregoing problems of a prior centrifugal separation tube, it is an object of the present invention to provide a centrifugal separation tube which makes it no longer necessary to transfer the cellular suspension from a larger volume tube to a smaller volume tube, and which prevents a cell pellet from being thrown away when supernatant liquid is discarded after centrifugation.

The present invention provides a compound centrifuge tube including a larger volume bottomless portion, and a smaller volume portion having a bottom and formed just below the larger volume portion. The smaller volume portion is designed to be separable from the larger volume portion.

The present invention further provides a compound centrifuge tube including a larger volume bottomless portion, a smaller volume portion having a bottom and integrally formed with the larger volume portion, the compound centrifuge tube being formed at an outer surface thereof with an annular groove so that a boundary between the larger and smaller portions has a smaller wall-thickness than other portions so as to cause the larger and smaller volume portions to be separable from each other, a first flange formed with the larger volume portion just above the annular groove, and a second flange formed with the smaller volume portion just below the annular groove.

The present invention still further provides a compound centrifuge tube including a larger volume bottomless portion having a threaded portion at a lower end thereof, a smaller volume portion having a bottom and also having a threaded portion at an upper end thereof, the threaded portions of the larger and smaller volume portions being to be engaged to each other.

The present invention yet further provides a compound centrifuge tube including a larger volume bottomless portion, a smaller volume portion having a bottom, a first flange formed with the larger volume portion at a lower end thereof, a second flange formed with the smaller volume portion at an upper end thereof, the second flange having the same shape as that of the first flange, and a binder for binding the larger and smaller portions with each other, the binder having a recess into which the first and second flanges overlapping one on another are to be inserted.

It is preferable that the compound centrifuge tube has an upwardly increasing internal diameter around the boundary between the larger and smaller volume portions.

The first and second flanges may take any shape, but the first and second flanges are preferably annular in shape.

The larger volume portion may be formed with at an upper end thereof with a threaded portion to which a cap is engageable.

It is preferable that the compound centrifuge tube has at least one recessed or raised portion at an outer surface thereof and just below the second flange. When a plurality of recessed or raised portions are formed, it is preferable that they have different shapes. It is also preferable that they are situated at specific positions in order to differentiate them at a glance.

In a preferred embodiment, the larger volume portion has a volume in the range of 5 ml to 100 ml, both inclusive, and the smaller volume portion has a volume in the range of 0.5 ml to 5 ml, both inclusive. An optimum selection of volumes of the larger and smaller volume portions can be determined in dependence on a solution to be handled or a method of handling.

The smaller volume portion preferably has a length of 50 mm or smaller. If the length is 50 mm or smaller, when the supernatant liquid is discarded after centrifugal separation, it is possible to discard the supernatant liquid by virtue of surface tension without even a part of the supernatant liquid being left in the smaller volume portion.

The compound centrifuge tube is preferably made of synthetic resin because of cost performance and ease of molding. In addition, it is preferable that the larger and smaller volume portions are transparent or semi-transparent so that the state of a solution inside the compound centrifuge tube can be readily seen.

There may be formed a scale on an outer surface of the compound centrifuge tube so that a content of the tube can be measured without any measurers.

In accordance with the compound centrifuge tube, a cell pellet, which remains after cells have been centrifuged and washed, sticks to a tip of the smaller volume portion, which makes it no longer necessary to transfer the cell pellet to a micro-tube with a pipette, as in a conventional centrifugal separation tube.

By designing an internal diameter of the compound centrifuge tube to be increasing towards the larger volume portion from the smaller volume portion around a boundary between these two portions, it is possible to discard all supernatant liquid subsequently to centrifugation/washing without the supernatant liquid remaining in the smaller volume portion.

The larger volume portion is separable from the smaller volume portion. Thus, by separating the smaller volume portion from the larger volume portion after discarding the supernatant liquid, the smaller volume portion can be used as a small tube for centrifugation.

When the larger and smaller volume portions are integrally formed, there is formed an annular groove at an outer surface of the compound centrifuge tube so that a boundary between the larger and smaller portions has a smaller wall-thickness than other portions so as to cause the larger and smaller volume portions to be separable from each other. The annular groove makes it easy to separate the smaller volume portion from the larger volume portion. The boundary having a smaller wall-thickness is reinforced by the flanges, so that there would arise no problems with respect to the strength of the tube even when the tube is being transferred or centrifuged.

The flange formed at an upper end of the smaller volume portion acts as a stopper to a centrifugal separator when the smaller volume portion that has separated from the larger volume portion is set into a centrifugal separator. The recessed or raised portion formed at an outer surface of the compound centrifuge tube just below the flange can act as a mark for positioning the smaller volume portion in a centrifugal separator, and also acts as a stopper to which a raised or recessed portion of a cap used for covering an opening of the smaller volume portion is to be engageable.

By using the raised or recessed portion as a mark and as a stopper, as mentioned above, it is possible to prevent a cell pellet being precipitated in the smaller volume portion from being thrown away together with supernatant liquid when only the supernatant liquid is to be discarded after the smaller volume portion that has been separated from the larger volume portion is set into a centrifugal separator to thereby accomplish centrifugation and washing.

BRIEF DESCRIPTION OF THE DRAWINGS

The above and other objects and advantageous features of the present invention will be made apparent from the following description made with reference to the accompanying drawings, in which like reference characters designate the same or similar parts throughout the drawings, in which.

DESCRIPTION OF THE PREFERRED EMBODIMENTS

Preferred embodiments in accordance with the present invention will be explained hereinbelow with reference to the drawings.

With reference to FIGS. 1 to 9B, there is described the first embodiment hereinbelow. A compound centrifuge tube 1 is made of transparent synthetic resin, and is comprised of a larger volume bottomless portion 2 having a volume of 12.0 ml and a smaller volume portion 3 having a volume of 1.5 ml disposed below the larger volume portion 2. These two portions 2 and 3 are integrally formed. Since the larger volume portion 2 is bottomless and the smaller volume portion 3 has a bottom, the compound centrifuge tube 1 comprising the larger and smaller volume portions 2 and 3 has a bottom.

Figure 1:
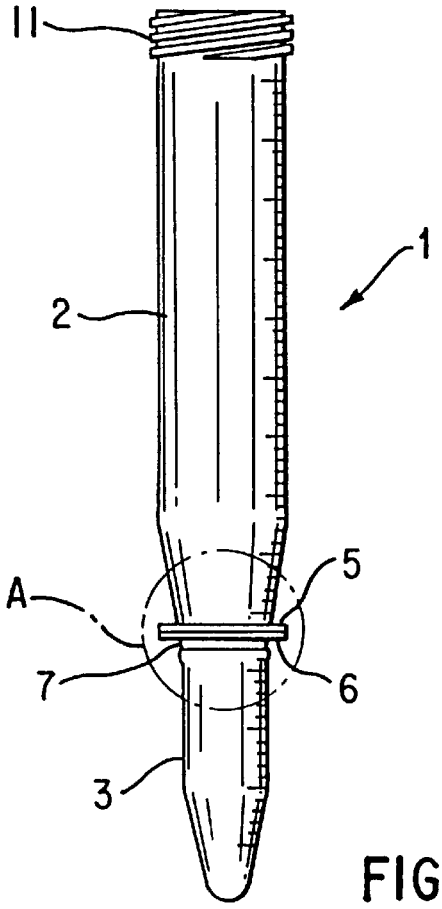
FIG. 1 is a front view illustrating a compound centrifuge tube made in accordance with the first embodiment of the present invention.
Figure 2:
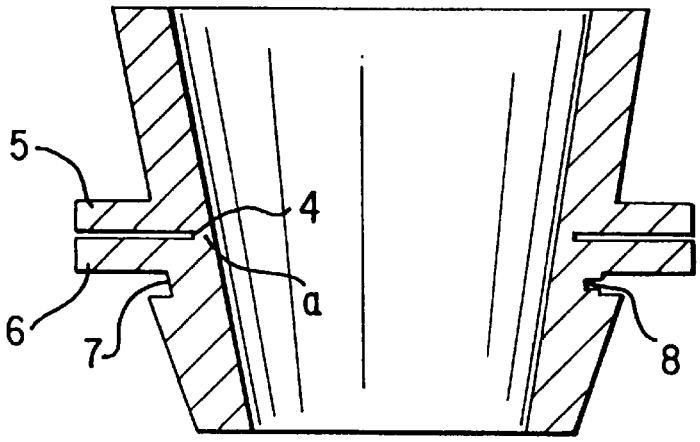
FIG. 2 is an enlarged longitudinal cross-sectional view of a portion A in FIG. 1.

As illustrated in FIGS. 1 and 2, an annular groove 4 is formed at an outer surface of the compound centrifuge tube 1 so that a boundary A between the larger and smaller portions 2 and 3 has a smaller wall-thickness than other portions so as to cause the larger and smaller volume portions 2 and 3 to be separable from one another. An annular first flange 5 is formed around the larger volume portion 2 just above the annular groove 4, and an annular second flange 6 is formed around the smaller volume portion 3 just below the annular groove 4.

An inner wall of the boundary portion A between the larger and smaller volume portions 2 and 3 is flat without irregularities and is tapered so that an internal diameter of the compound centrifuge tube 1 increases from a bottom towards top of the compound centrifuge tube 1.

Figure 3:
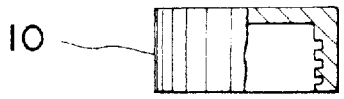
FIG. 3 is a front view illustrating a cap to be used for the compound centrifuge tube illustrated in FIG. 1 with portions omitted for the sake of clarity.
Figure 4:
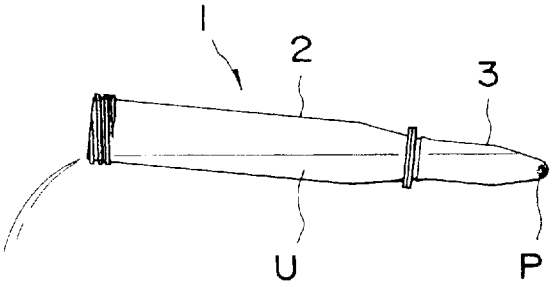
FIG. 4 illustrates the supernatant liquid being discarded from the compound centrifuge tube.

The larger volume portion 2 has an upper external diameter of about 17 mm, a lower external diameter of about 13 mm, and a length of about 85 mm. The larger volume portion 2 is formed at an upper end thereof with a threaded portion 11 to which a cap 10 illustrated in FIG. 3 is to be screwed.

Figure 6:
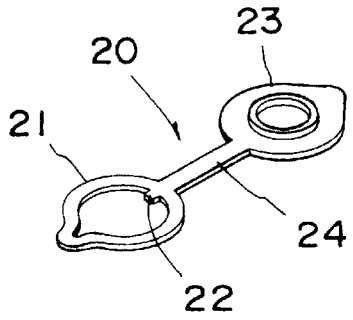
FIG. 6 is a perspective view of a cap to be used for covering an opening of the smaller volume portion.

The smaller volume portion 3 is formed continuously with a lower end of the larger volume portion 2, and has a decreasing diameter toward a bottom of the tube 1. The smaller volume portion 3 has an external diameter of about 5 mm at a lower end thereof, and a length of about 38 mm. The smaller volume portion 3 is formed at a foot of the second annular flange 6 with an annular groove 7 to which a cap 20 illustrated in FIG. 6 is to be engaged. As illustrated in FIG. 2, a recessed portion 8 is formed at an outer surface of the smaller volume portion 3 so that the recessed portion 8 is situated in the groove 7.

The smaller volume portion 3 can be separated from the larger volume portion 2 at a boundary portion a. After separation, the smaller volume portion 3 can be used as a small tube for centrifugation.

Since the annular groove 4 is formed at an outer surface of the compound centrifuge tube 1 so that the boundary portion a has a smaller wall-thickness than other portions so as to cause the larger and smaller volume portions 2 and 3 to be separable from each other, the smaller volume portion 2 can be readily separated from the larger volume portion 3. The boundary "a" having a smaller wall-thickness is reinforced by the first and second flanges 5 and 6, so that there would arise no problems with respect to the strength of the tube 1 even when the compound centrifuge tube 1 is being transferred or centrifuged.

Figure 8:
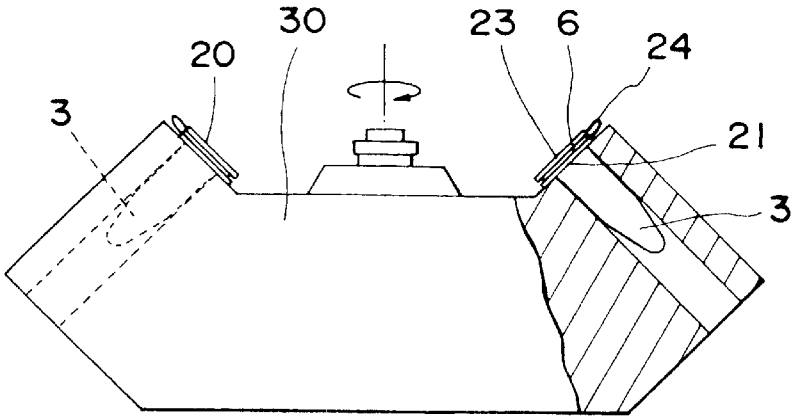
FIG. 8 is a schematic view of a centrifugal separator into which the smaller volume portion is set.

As illustrated in FIG. 8, the second flange 6 formed at an upper end of the smaller volume portion 3 acts as a stopper to a centrifugal separator 30, when the smaller volume portion 3 that as been separated from the larger volume portion 2 is set into the centrifugal separator 30 as a small tube.

Figure 7:
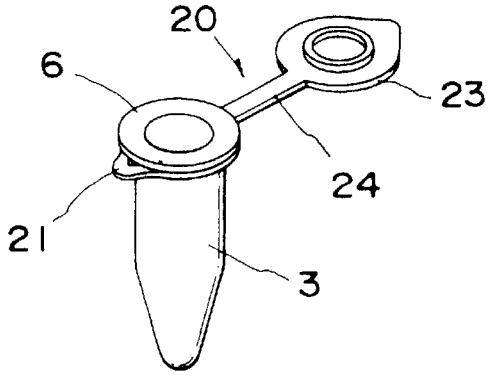
FIG. 7 is a perspective view illustrating the smaller volume portion to which the cap illustrated in FIG. 6 is engaged.

When the smaller volume portion 3 that as been separated from the larger volume portion 2 is used as a small tube for centrifugation, the cap 20 illustrated in FIG. 6 is used. When the cap 20 is connected to the smaller volume portion 2 in such a fashion as illustrated in FIG. 7, a fixation ring 21 of the cap 20 is engaged around the annular groove 7 formed at a foot of and just below the second flange 6.

The fixation ring 21 of the cap 20 is formed at an internal circumference thereof with a projection 22 which is inserted into the recessed portion 8 formed at an outer surface of the tube 1 within the groove 7. The insertion of the projection 22 into the recessed portion 8 surely fixes the cap 20 to the smaller volume portion 3, and also prevents the rotation of the cap 20 relative to the smaller volume portion 3.

Figure 9A:
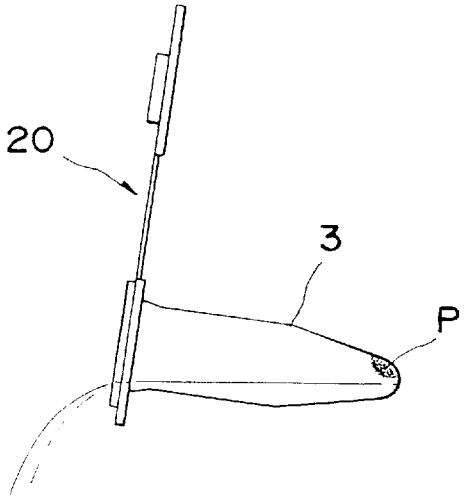
FIG. 9A illustrates supernatant liquid being discarded from the smaller volume portion with a cell pellet attached to an upper inner wall thereof.

The recessed portion 8 formed at an outer surface of the compound centrifuge tube 1 just below the second flange 6 can act as a mark for positioning the smaller volume portion 3 to a centrifugal separator. Namely, the compound centrifuge tube 1 is set to a centrifugal separator so that the recessed portion 8 is situated outermost. By setting the compound centrifuge tube 1 in such a way, a cell pellet P, which will remain at a distal end of the smaller volume portion 3 after centrifugation/washing, sticks to an inner wall of the smaller volume portion 3 at the same side as the recessed portion 8, as illustrated in FIG. 9A. Thus, it is possible for the cell pellet P to remain situated at the same side as the recessed portion 8 by setting the recessed portion 8 outermost, when the smaller volume portion 3 that has been separated from the larger volume portion 2 is set into the centrifugal separator 30 again.

When the cap 20 illustrated in FIG. 6 is set onto the smaller volume portion 3 that been separated from the larger portion 2 in such a fashion as illustrated in FIG. 6, a connection 24 of the cap 20 corresponds in position to the recessed portion 8 of the smaller volume portion 3. Thus, it is preferable that the smaller volume portion 3 is set into the centrifugal separator 30 as illustrated in FIG. 8 so that the connection 24 of the cap 20 is situated outermost. Thus, after the cap 20 has been set to the smaller volume portion 3, the connection 24 of the cap 20 can act as a mark for positioning.

Figure 9B:
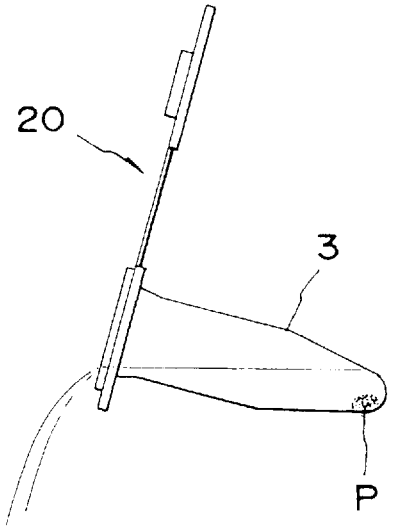
FIG. 9B illustrates supernatant liquid being discarded from the smaller volume portion with a cell pellet attached to a lower inner wall thereof.

When supernatant liquid is to be discarded, as illustrated in FIG. 9A, the smaller volume portion 3 is tilted so that the recessed portion 8 and hence the connection 24 of the cap 20 is directed upward. Thus, the cell pellet P is also directed upward, so that it is possible to prevent the cell pellet P from being thrown out together with the supernatant liquid. If the recessed portion 8 was not formed, as illustrated in FIG. 9B, the connection 24 of the cap 20 may be situated at the opposite side of the cell pellet P. In such a case, the cell pellet P is situated in the supernatant, and hence the cell pellet P is likely to be thrown out of the smaller volume portion 3 together with the supernatant liquid.

When cells are centrifuged by using the compound centrifuge tube 1 having the above mentioned structure, the cap 10 is first removed from the compound centrifuge tube 1. Thereafter, cellular suspension solution is introduced into the tube 1, and then the cap 10 is screwed to the threaded portion 11 formed at an upper end of the larger volume portion 2. Centrifugation is then carried out at 100 to 600 G for 3 to 30 minutes. After the centrifugation is completed, the cap 10 is removed again, and then the compound centrifuge tube 1 is tilted ultimately over 90 degrees from a vertical line to thereby discard supernatant liquid U. Since the compound centrifuge tube 1 has a flat, smooth tapered inner surface across the boundary portion a between the larger and smaller volume portions 2 and 3, all the supernatant liquid U is smoothly thrown out, and thus only the cell pellet P is left at a tip of the smaller volume portion 3. Then, 5 to 100 ml of washing solution is added into the smaller volume portion 3 to thereby make cellular suspension solution. There is carried out centrifugation again. The above mentioned steps are repeated 1 to 4 times as occasion demands.

Figure 5:
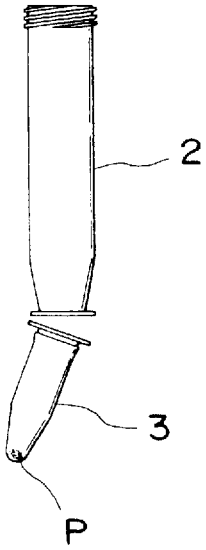
FIG. 5 illustrates the compound centrifuge tube being separated into two portions.

After all the supernatant liquid is discarded, the smaller volume portion 3 is separated from the larger volume portion 2, as illustrated in FIG. 5, with only the cell pellet P being left at a bottom of the smaller volume portion 3. Hereinafter, the smaller volume portion 3 can be used as a small tube.

The cap 20 illustrated in FIG. 6 is then provided to the small tube 3 so as to extract DNA or RNA from the cell pellet left in the small tube 3, or to freeze-preserve the cell pellet as it is. The fixation ring 21 of the cap 20 is inserted through a bottom of the small tube 3, and then the fixation ring 21 is made to be engage to the groove 7 formed at a foot of and just below the second flange 6 so that the projection 22 formed within the fixation ring 21 is engaged to the recessed portion 8 formed within the groove 7.

When the small tube 3 is set to the centrifugal separator 30, as illustrated in FIG. 8, the connection 24 of the cap 20 is folded into thereby fit a fitting portion 23 into an opening of the small tube 3. Then, the small tube 3 is set to the centrifugal separator 30 so that the engagement of the projection 22 to the recessed portion 8 is situated outermost.

After centrifugation is finished, as illustrated in FIG. 9A, the fitting portion 23 is disengaged from the small tube 3 and the small tube 3 is tilted to thereby discard the supernatant liquid. Since the cell pellet P is situated on an upper inner wall of the small tube 3, the cell pellet P is not thrown away together with the supernatant liquid.

The cells left in the small tube 3 in the form of pellet may be preserved by introducing freezing mixture into the small tube 3, or frozen for extraction of genes. As an alternative, DNA or RNA is extracted out of the cell pellet left in the small tube 3.

Hereinbelow is described a compound centrifuge tube made in accordance with the second embodiment with reference to FIG. 10. A compound centrifuge tube 41 is made of transparent synthetic resin, and is comprised of a larger portion 42 and a smaller portion 43 in threaded connection with each other. The larger and smaller volume portions 42 and 43 have the same dimensions and volumes as those of the first embodiment.

Figure 10:
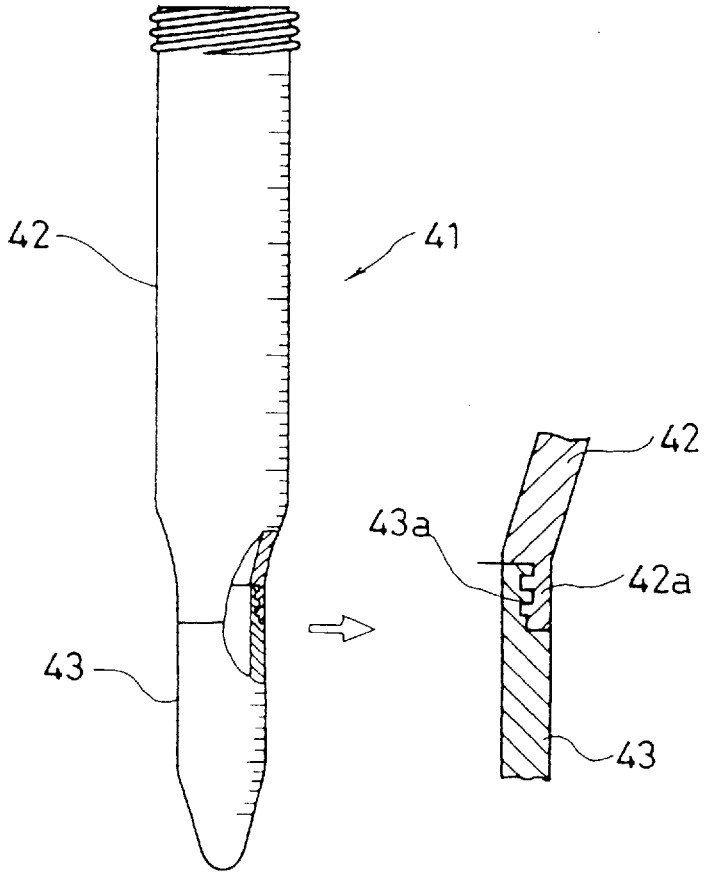
FIG. 10 is a front view illustrating a compound centrifuge tube made in accordance with the second embodiment of the present invention with portions omitted for the sake of clarity, including an enlarged view of the omitted portions.
Figure 11:
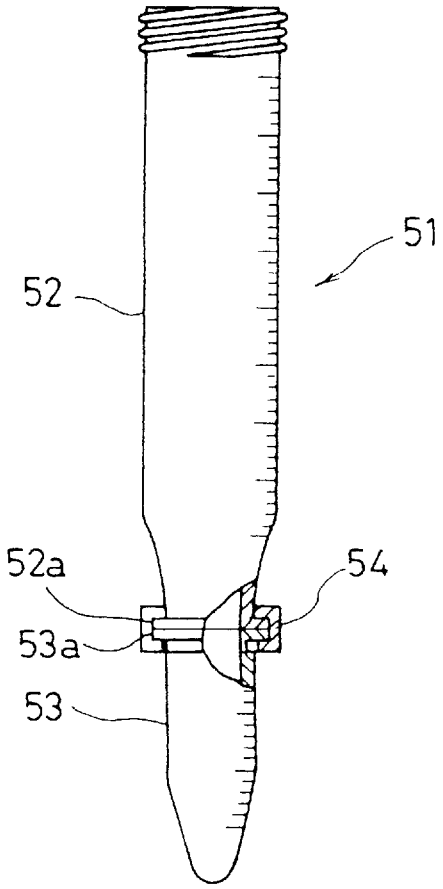
FIG. 11 is a front view illustrating a compound centrifuge tube made in accordance with the third embodiment of the present invention with portions omitted for the sake of clarity.

As illustrated in an enlarged figure in FIG. 10, the larger volume portion 42 is formed at a lower end thereof with an internally threaded portion 42*a*, and the smaller volume portion 43 is formed at an upper end thereof with an externally threaded portion 43*a*. Thus, the larger and smaller volume portions 42 and 43 can be engaged to each other, and be readily separated from each other. On the contrary to an arrangement illustrated in FIG. 10, the larger volume portion 42 may be formed at a lower end thereof with an externally threaded portion, and the smaller volume portion 43 may be formed at an upper end thereof with an internally threaded portion. If necessary, an O-ring may be disposed between a lower end of the larger volume portion 42 and an upper end of the smaller volume portion 43.

The threaded connection between the larger and smaller volume portions 41 and 42 ensures solid connection which does not loosen even in centrifugation. In addition, the two portions 41 and 42 can be readily separated from each other only by loosening the threaded portions. The smaller volume portion 43 having been separated from the larger volume portion 42 can be used as a small tube for centrifugation. In such a case, a cap (not illustrated) can be threaded into the externally threaded portion 43*a* of the smaller volume portion 43.

The compound centrifuge tube 41 having the above mentioned structure is used in essentially the same way as the compound centrifuge tube 1 in the first embodiment. For instance, when cells are centrifuged, a cellular suspension is introduced into the compound centrifuge tube 41 comprising the larger and smaller volume portions 42 and 43 connected to each other, and then centrifugation is carried out. After the centrifugation is finished, supernatant liquid is discarded, and then washing solution is added into the cell pellet left at a bottom of the smaller volume portion 43 to thereby make a further cellular suspension. Then, centrifugation is carried out again. The above mentioned steps are repeated 1 to 4 times as occasion demands.

After all the supernatant liquid is discarded, the smaller volume portion 43 is separated from the larger volume portion 42 with only the cell pellet being left at a bottom of the smaller volume portion 43. When the cell pellet left in the smaller volume portion 43 is to be centrifuged and washed again, a cap (not illustrated) is threaded into an upper end of the smaller volume portion 43.

With reference to FIGS. 11 to 13B, hereinbelow is described a compound centrifuge tube made in accordance with the third embodiment of the present invention. A compound centrifuge tube 51 is made of transparent synthetic resin, and is comprised of a larger volume portion 52 and a smaller volume portion 52 which are connected to each other by means of a binder 54. The larger and smaller volume portions 52 and 53 have the same dimensions and volumes as those of the first embodiment.

Figure 12:
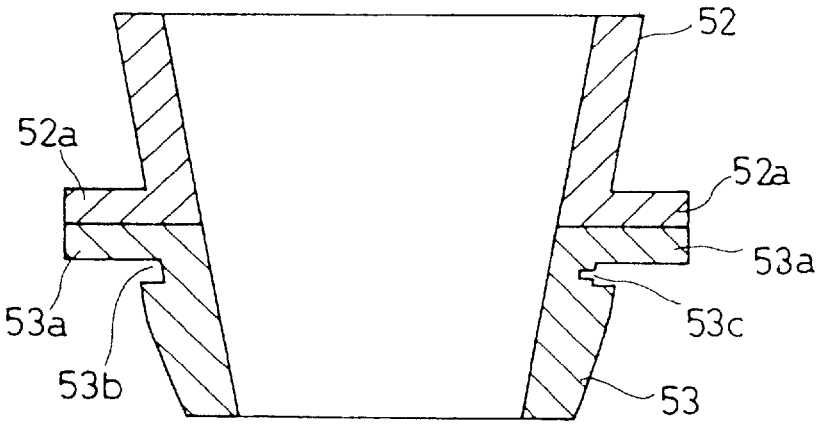
FIG. 12 is an enlarged cross-sectional view of a part of the compound centrifuge tube illustrated in FIG. 11.

As illustrated in FIG. 12, the larger volume portion 52 is formed at a lower end thereof with an annular flange 52*a*, and the smaller volume portion 53 is formed at an upper end thereof with an annular flange 53*a* having the same shape as the flange 52*a*. The larger and smaller volume portions 52 and 53 are connected with each other by aligning them with each other and fitting the binder 54 illustrated in FIG. 13A into the aligned flanges 52*a* and 53*a*.

As illustrated in FIG. 12, an inner wall of a boundary portion between the larger and smaller volume portions 52 and 53 is made flat without irregularities and is tapered so that an internal diameter of the compound centrifuge tube 51 is increasing from a bottom towards a summit of the compound centrifuge tube 51. There is formed an annular groove 53*b* at a foot of and just below the flange 53*a*. The cap 20 illustrated in FIG. 6 is provided around the groove 53*b*. There is also formed a recessed portion 53*c* at an outer surface of the smaller volume portion 53 within the groove 53*b*.

Figure 13A:
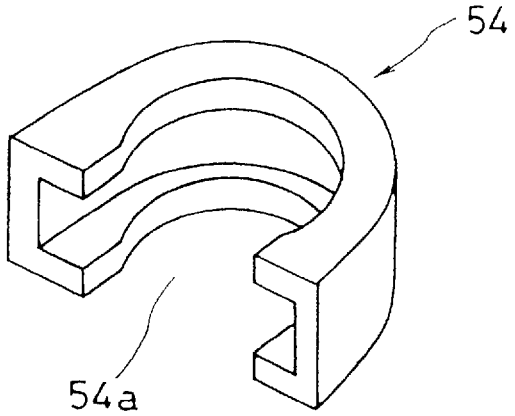
FIG. 13A is a perspective view illustrating a binder to be used for the compound centrifuge tube.
Figure 13B:
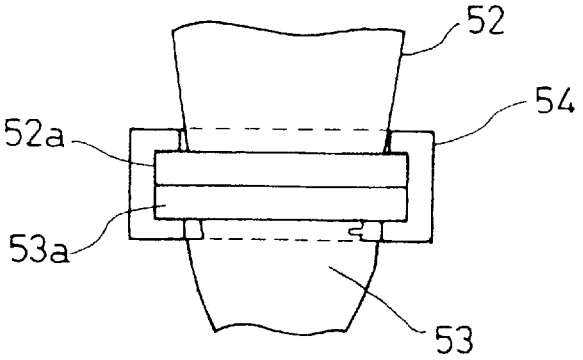
FIG. 13B illustrates the larger and smaller volume portions being bound to each other through the binder illustrated in FIG. 12.

As illustrated in FIG. 13A, the binder 54 is half-arcuate in shape and has a substantially U-shaped cross-section. The binder 54 has an opening 54*a* at one side, and is made of synthetic resin. The larger and smaller volume portions 52 and 53 are connected with each other by aligning the flanges 52*a* and 53*a* with each other and equipping the binder 54 around the aligned flanges 52*a* and 53*a*, as illustrated in FIG. 13B. The binder 54 has resiliency because it is made of synthetic resin. Thus, by designing an internal dimension of the opening 54*a* of the binder 54 to be slightly smaller than external diameters of the flanges 52*a* and 53*a*, it is possible to tightly fit the binder 54 to the aligned flanges 52*a* and 53*a*, which ensures no disengagement of the larger and smaller volume portions 52 and 53. If necessary, there may be disposed an O-ring between the flanges 52*a* and 53*a*.

The binder 54 by which the larger and smaller volume portions 52 and 53 are connected with each other ensures solid connection between the two portions 52 and 53 and also ensures no disengagement even in centrifugation. The larger and smaller volume portions 52 and 53 can be readily separated from each other by removing the binder 54 from the aligned flanges 52*a* and 53*a*. In addition, the smaller volume portion 53 having been separated from the larger volume portion 52 can be used as a small tube for centrifugation.

Similarly to the first embodiment, the flange 53*a* of the smaller volume portion 53 acts as a stopper to a centrifugal separator when the smaller volume portion 53 that has been separated from the larger volume portion 52 is set into the centrifugal separator as a small tube. The groove 53*b* formed at a foot of and just below the flange 53*a* acts in the same fashion as in the first embodiment. Namely, when the cap 20 illustrated in FIG. 6 is provided to the smaller volume portion 53 that has been separated from the larger volume portion 52 and hence acts as a small tube, the fixation ring 21 of the cap 20 fits into the groove 53*b*. In addition, similarly to the first embodiment, the projection 22 formed with the fixation ring 22 is inserted into the recessed portion

53*c* formed within the groove 53*b*, and the engagement of the projection 22 into the groove 53*b* acts as a mark for positioning the smaller volume portion 53 as a small tube onto a centrifugal separator.

While the invention has been described in connection with the preferred embodiments, the invention provides many advantages as follows.

Since the smaller volume portion is designed to be separable from the larger volume portion, it is no longer necessary to transfer cell containing solution to a micro-tube from a centrifugal separation tube. Thus, it is possible to prevent loss of cells and damage to cells caused by cells sticking to an inner wall of a container or a pipette from which a cell containing solution is to be transferred to a micro-tube.

It is possible to preserve cells in the smaller volume portion having been separated from the larger volume portion. Thus, the cells can be preserved in a smaller space than a conventional centrifugal separation tube.

By providing taper to an inner wall of the tube around a boundary between the larger and smaller volume portions so that an inner diameter of the compound centrifuge tube increases toward a summit from a bottom of the tube, all supernatant liquid can be thrown out of the tube by tilting the tube.

The recessed or raised portion formed at an outer surface of the smaller volume portion just below the flange acts as a mark for positioning. When supernatant liquid is discarded after centrifugation, the smaller volume portion, which has been separated from the larger volume portion and hence can act as a small tube, is tilted so that the recessed or raised portion is situated at the upper side, thereby preventing precipitate or a cell pellet from being thrown out together with the supernatant liquid.

It is possible to identify where a cell pellet is in the smaller volume portion with naked eyes, which facilitates to dealing with the cell pellet with a micro-pipette in gene extraction. When the smaller volume portions having been separated from the larger volume portion is repeatedly used for centrifugation, it is possible to situate the precipitate at the same site, and hence it is also possible to reduce non-uniform treatment of the precipitate.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A compound centrifuge tube, comprising:

a first bottomless tube portion, defining a volume, and having a top, a bottom end, an inner wall, and a first annular flange disposed around the bottom end;

a second tube portion in one piece with the first tube portion, defining a volume smaller than the volume of the first tube portion, having a top end in one piece with the bottom end of the first tube portion, a bottom, an inner wall, a second annular flange formed around the top end of the second tube portion; and an annular groove formed between the first and second annular flanges, forming a frangible wall portion and separable boundary portion between the first and second tube portions.

2. A compound centrifuge tube as set forth in claim 1, wherein said first tube portion further comprises a top end, and an external threaded portion at the top end.

3. A compound centrifuge tube as set forth in claim 1, wherein the volume of the first tube portion is in the range of from 5 ml to 100 ml, both inclusive, and the volume of the second tube portion is in the range of from 0.5 ml to 5.0 ml, both inclusive.

4. A compound centrifuge tube as set forth in claim 1, wherein the first flange has an external diameter substantially equal to an external diameter of the second flange.

5. A compound centrifuge tube, comprising:

a first bottomless tube portion, defining a volume, and having a top, a bottom end, an inner wall, and a first annular flange disposed around the bottom end;

a second tube portion in one piece with the first tube portion, defining a volume smaller than the volume of the first tube portion, having a top end in one piece with the bottom end of the first tube portion, a bottom, an inner wall, a second annular flange formed around the top end of the second tube portion; and a removable, resilient arcuate binder having a U-shaped cross section binding the first and second flanges together; and wherein the inner wall of the second tube portion tapers outwardly and joins flatly without irregularities to the inner wall of the first tube portion, and tapers so that an internal diameter of the compound centrifuge tube increases from the second tube portion to the first tube portion.

6. A compound centrifuge tube as set forth in claim 5, wherein said first tube portion further comprises a top end, and an external threaded portion at the top end.

7. A compound centrifuge tube as set forth in claim 5, wherein the volume of the first tube portion is in the range of from 5 ml to 100 ml, both inclusive, and the volume of the second tube portion is in the range of from 0.5 ml to 5.0 ml, both inclusive.

8. A compound centrifuge tube as set forth in claim 5, wherein the first flange has an external diameter substantially equal to an external diameter of the second flange.

9. A compound centrifuge tube as set forth in claim 5, further comprising a second annular groove below said second annular flange.

10. A compound centrifuge tube as set forth in claim 9, wherein said second annular groove comprises a recessed portion.

11. A compound centrifuge tube, comprising:

a first bottomless tube portion, defining a volume, and having a top, a bottom end, an inner wall, and a first threaded portion disposed around the bottom end, a second tube portion, defining a volume smaller than the volume of the first tube portion, having a top end, a second tube portion in one piece with the first tube portion, defining a volume smaller than the volume of the first tube portion, having a top end in one piece with the bottom end of the first tube portion, a bottom, an inner wall, a second threaded portion disposed at the top end of the second tube portion and engagable with the first threaded portion, wherein, when the first threaded portion is engaged with the second threaded portion, the inner wall of the second tube portion tapers outwardly and joins flatly without irregularities to the inner wall of the first tube portion, and tapers so that an internal diameter of the compound centrifuge tube increases from the second tube portion to the first tube portion.

12. A compound centrifuge tube, comprising:

a first bottomless tube portion, defining a volume, and having a top, a bottom end, an inner wall, and a first annular flange disposed around the bottom end;

a second tube portion in one piece with the first tube portion, defining a volume smaller than the volume of the first tube portion, having a top end in one piece with the bottom end of the first tube portion, a bottom, an inner wall, a second annular flange formed around the top end of the second tube portion; and an annular groove formed between the first and second annular flanges, forming a frangible wall portion and separable boundary portion between the first and second tube portions; and wherein the inner wall of the second tube portion tapers outwardly and joins flatly without irregularities to the inner wall of the first tube portion, and tapers so that an internal diameter of the compound centrifuge tube increases from the second tube portion to the first tube portion.

13. A compound centrifuge tube as set forth in claim 12, further comprising a second annular groove below said second annular flange.

14. A compound centrifuge tube as set forth in claim 13, wherein said second annular groove comprises a recessed portion.

15. A compound centrifuge tube, comprising:

a first bottomless tube portion, defining a volume, and having a top, a bottom end, an inner wall, and a first annular flange disposed around the bottom end;

a second tube portion in one piece with the first tube portion, defining a volume smaller than the volume of the first tube portion, having a top end in one piece with the bottom end of the first tube portion, a bottom, an inner wall, a second annular flange formed around the top end of the second tube portion;

an annular groove formed between the first and second annular flanges, forming a frangible wall portion and providing a separable boundary portion between the first and second tube portions; and a second annular groove below said second annular flange, said second annular groove comprising a recessed portion.

* * * * *